United States Patent [19]

Beringer et al.

[11] 4,083,371

[45] Apr. 11, 1978

[54] PROCESS FOR PRODUCTION OF ARTIFICIAL TOBACCO

[75] Inventors: Monique Beringer, Saint Louis, France; Heinz Spörri, Egg, Zurich, Switzerland

[73] Assignee: Fabriques de Tabac Reunies S.A., Neuchatel, Switzerland

[21] Appl. No.: 709,250

[22] Filed: Jul. 27, 1976

[30] Foreign Application Priority Data

Jul. 29, 1975 Luxembourg ..... 73096

[51] Int. Cl.[2] ..... A24B 15/00; A24D 1/18; A24B 3/14

[52] U.S. Cl. ..... 131/2; 131/140 C

[58] Field of Search ..... 131/2, 17 R, 140 R, 131/17 C, 17 AC, 17 AB, 140 C, 17 A, 17 AE, 137

[56] References Cited

U.S. PATENT DOCUMENTS

| | | | |
|---|---|---|---|
| 2,734,510 | 2/1956 | Hungerford et al. | 131/140 C |
| 2,845,933 | 8/1958 | Samfield et al. | 131/140 C |
| 3,141,462 | 7/1964 | Block et al. | 131/140 C |
| 3,820,548 | 6/1974 | Buchmann et al. | 131/140 C |

OTHER PUBLICATIONS

*"Alteration of Cigarette Smoke Composition I. Influence of Certain Additives"* by Terrel et al., Published in Tobacco magazine, May 29, 1970, pp. 19–22.

*Characteristic Products from Pyrolysis of Nitrogenous Organic Substances* by Schmectz et al., published by Eastern Utilization Research and Development Division, Agricultural Research Service, United States Department of Agriculture, Philadelphia, Pa. USA pp. 134–138.

*Tobacco from Domestic Plants* by Dieckman, Published by R. Dietze, Berlin-Johannisthal, 11555 (Germany, West), Aug. 2, 1946.

*Primary Examiner*—Robert W. Michell
*Assistant Examiner*—V. Millin
*Attorney, Agent, or Firm*—Peter K. Kontler

[57] ABSTRACT

To produce artificial tobacco from a moist paste moist paste is predried to a 15 to 25% by weight liquid content by pressing out liquid and then shaped and hardened by final drying to convert it into artificial tobacco.

9 Claims, 2 Drawing Figures

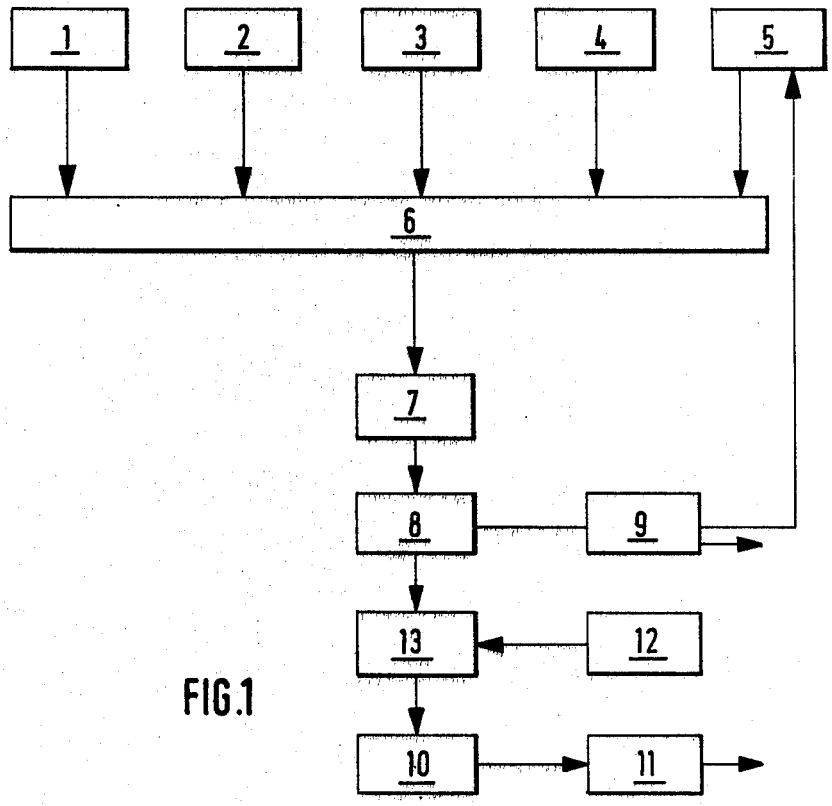
FIG.1
FIG.2
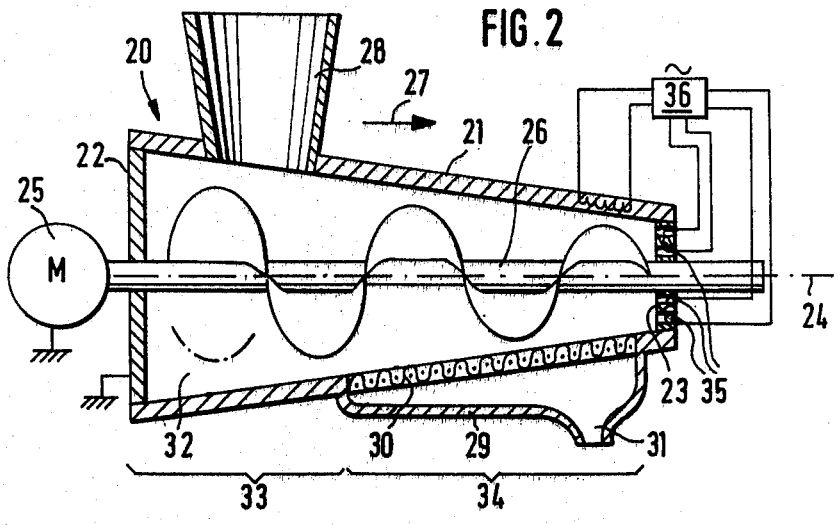

PROCESS FOR PRODUCTION OF ARTIFICIAL TOBACCO

BACKGROUND AND SUMMARY OF THE INVENTION

The invention relates to a process for the production of artificial tobacco and an apparatus for performing this process.

It is known to produce artificial tobacco by shaping and drying a moist paste of plant parts, binders, adsorbents, further chemicals and liquid. In order to ensure that the chemicals are distributed as uniformly as possible in the paste, the latter must contain more liquid than is necessary for further processing. The resultant paste has been hitherto shaped into for example sheets, fibres, strips, foils and the like, and then the liquid contained, other than a residual quantity, removed by evaporation. This procedure requires substantial energy to remove the excess liquid and it is an object of the present invention to reduce this amount of energy.

The process according to the invention is characterised in that the paste is mixed at a 30 to 40% by weight liquid content, is then predried to a 15 to 25% by weight liquid content by pressing out liquid and then shaped and hardened by drying to a 6 to 18% by weight liquid content to form artificial tobacco. The paste is initially mixed with the liquid content desirable for a homogeneous distribution of the chemicals and that portion of the liquid content which is not necessary for shaping is removed by simply squeezing out, so that the shaped sheets etc. are drier from the outset and subsequently require only a relatively small drying energy for the final drying process.

The liquid to be pressed out is generally mainly water, but it is not pure water which is removed from the paste. The pressed out liquid contains dissolved chemical constituents as well as vegetable matter. However, this is not disadvantageous because the substances removed from the paste in this way can be added to a subsequent charge. The liquid obtained during squeezing out can be added directly to a paste which is to be subsequently mixed, or alternatively can be cleaned before such addition.

Experience has shown that a high proportion of albumins is disadvantageous for the smoking flavour of artificial tobacco. It is never possible to completely avoid such albumins, because they are present in almost all plant parts. However, the albumin content can be reduced by subjecting the liquid obtained during squeezing to an albumin separation process during which at least the larger proportion of the albumins contained are separated.

The smoking flavour and burning characteristics of the artificial tobacco are also impaired by various anions. Therefore, when cleaning the liquid, it is recommended to separate chlorides and/or nitrate ions therefrom by ion exchange. Thus, the invention makes it possible to clean the starting material for the artificial tobacco, i.e. the moist paste, and this can take place in a very simple manner, because the cleaning measures are performed on the pressed out liquid.

It is desirable to prevent added chemicals being lost with the pressed out liquid or during the cleaning thereof and account is taken of this in a further embodiment of the invention which is characterised in that at least a proportion of the binders, adsorbents and further chemicals is only added to the paste after the said predrying thereof.

It is desirable for the process of the invention to be performed on a continuous basis and a suitable apparatus for this purpose comprises a screw conveyor which is mounted coaxially in a circular cylindrical casing;

a charging hopper at the upstream end of the casing;

a liquid drain at the downstream end of the casing, the screw conveyor being so constructed as to have an increasing compressing action on the material conveyed in the conveying direction; and the downstream end wall of the casing being foraminous.

It is recommended that a heating device be provided for heating the casing and/or the foraminous wall in order to increase the flowability of the predried paste in the kneading and compressing device.

These and further objects, features and advantages of the present invention will become apparent upon perusal of the following description when taken in connection with the accompanying drawings which show for purposes of illustration only several embodiments of the present invention.

BRIEF DESCRIPTION OF THE DRAWINGS

FIG. 1 is a flow chart of the process according to a preferred embodiment of the present invention and, FIG. 2 shows a kneading and compressing device for performing the process of the invention.

DETAILED DESCRIPTION OF THE DRAWINGS

Referring to FIG. 1, 50 to 300 $\mu$ dry-ground plant parts (Box 1), 100 to 300 $\mu$ pulverised adsorbents (Box 2), chemicals (Box 3), water (Box 4) and recycled liquids (Box 5) are mixed together (Box 6) to form a paste having a total liquid content of 30 to 40% by weight. This mixture is kneaded, (Box 7) and then compressed at a pressure of 200 to 1,000 atmospheres, preferably 300 to 500 atmospheres (Box 8) and as a result, part of the liquid is discharged in the form of a liquid slurry which undergoes a cleaning process (Box 9). The kneaded paste is predried by the said compression and has a liquid content of 15 to 25% by weight. The predried paste is mixed (Box 13) with adsorbents, binders and chemicals (Box 12). The mixed paste is passed at a pressure of 200 to 1,000 atmospheres, preferably 300 to 500 atmospheres, through a foraminous plate or other die (Box 10) where it is shaped into, for example, strips, fibres, flakes, foils and the like, which subsequently are finally dried and hardened by evaporating the excess liquid to a liquid content of 6 to 16% by weight to form artificial tobacco.

The cleaned slurry (Box 9) is used (Box 5) for subsequent mixing, when it is concomitantly processed. During the cleaning process, a large proportion of the albumin content is preferably removed from the paste.

As a modification of the represented flow chart, it is possible to eliminate the mixing process (Box 13) and further addition of ingredients (Box 12), whereby all the adsorbents, binders and further chemicals (Boxes 2 and 3) are added to the mixture from the outset.

As a further modification of the represented flow chart, the mixing (Box 6) can take place in a single compressing and kneading apparatus.

FIG. 2 shows in section an apparatus for performing the steps of kneading (Box 7), the pressing (Box 8) and extruding (Box 10).

Referring to FIG. 2, circular, cylindrical, substantially horizontal casing 20 has a cylinder jacket 21 closed at both ends by end walls 22 and 23. A compressing screw conveyor 26 driven in rotary manner by motor 25, located coaxially to the cylinder axis 24 of casing 20 is mounted coaxially in said casing 20, whereby when said conveyor 26 rotates, it conveys material in the direction of arrow 27. At the upstream end of the casing, a hopper 28 opens into the top of the casing and through said hopper the mixture is continually supplied with moist paste (Box 6). The end wall 23 is foraminous to constitute an extrusion die plate. A duct 29 is fixed to the bottom of casing 20, said duct being covered relative to the inside of casing 20 by a screen or filter 30 and discharges into a liquid drain 31. The screw conveyor 26 tapers conically in the conveying direction and at its upstream end leaves free a wide gap 32 towards the jacket 21, whereby in the conveying direction, said gap progressively tapers until at the downstream end, it finally becomes as narrow as is permitted by the necessary rotational tolerance. Thus, in the upstream zone 33, the screw conveyor mainly has a kneading action, because the paste conveyed by the conveyor has a considerable opportunity to flow back into gap 32, whilst in the downstream zone 34, it has an increasing compressing action, because the possibility of flowing back through gap 32 becomes increasingly less, so that finally the compressed paste arrives with maximum pressure in front of end wall 23 and is pressed out through the nozzles 35 in the desired sheet, flake or like form. Duct 29 extends over the compressing zone 34, in which an increasing amount of liquid is squeezed out of the paste and flows via the duct and the liquid drain in the form of liquid slurry and is then cleaned (Box 9) and can be used again (Box 5). The sheets etc. extruded through the end wall 23 are dried with a heating device, for example, by steam heating or electromagnetic microwaves (Box 11). The reference numeral 36 designates an electrical heating device for heating the casing jacket 21 and the end wall 23.

With minor modifications, the kneading and compressing device for performing the process of the invention can comprise kneading and compressing devices conventionally used for the industrial production of alimentary pastes.

EXAMPLE 1

2,000g of wheat chaff, 2,000g of oats chaff, 500g of coconut shells and 500g of cocoa bean husks are dry-ground to 50 to 300 $\mu$ and stored (Box 1), whilst 1,200g of meerschaum are ground to 150 to 300 $\mu$ and stored (Box 2). In addition, a mixture of 600g of magnesium formate, 150g of tartaric acid, 300g of potassium nitrate, 690g of urea, 300g of diammonium hydrogen phosphate, 7.5g of vanillin, 600g of calcium carbonate, 300g of paraffin, 1,125g of sodium carboxymethyl cellulose, 50g of pectin, 75g of glyoxal, 1,350g of glycerine, 150g of diethylene glycol, 1,000g of fruit concentrate, 600g of raw molasses, 100g of caramel and 150g of malt extract is prepared (Box 3). 5 liters of water are provided (Box 4). A cleaned, recycled liquid with a liquid content of in all 2 liters, resulting from a previous charge of the same type is also provided (Box 5). The said substances (Boxes 1 to 5) are mixed together (Box 6). This mixture is substantially homogenised by kneading (Box 7) and then predried by compressing (Box 8) using pressures of 700 to 800 atmospheres to remove 2 liters of liquid in the form of a liquid slurry. The thus predreid paste is pressed at a pressure of 800 to 900 atmospheres through nozzles which are shaped in such a way that 1mm wide and 0.2mm thick sheets or fibres are obtained, which are then dried to a moisture content of 8%, by irradiating with electromagnetic microwaves so that they harden to form artificial tobacco fibres.

80 to 95% by weight of the albumins obtained are precipitated from the liquid slurry by addition of ethyl-alcohol. The albumins are filtered off with the suspended particles of the slurry and the alcohol is evaporated. 80 to 98% by weight of the chloride ions and nitrate ions are removed by ion-exchange from the now almost albumin-free filtrate and the resultant liquid is stored (Box 5) for the next charge.

EXAMPLE 2

1,750g of oats chaff and 350g of cocoa bean husks are dry-ground to max. 500 $\mu$ and stored (Box 1). 2,500g of meerschaum are ground to 150 to 300 $\mu$ and stored (Box 2). A mixture of 800g of magnesium formate, 200g of tartaric acid, 300 of urea, 100g of diammonium hydrogen phosphate, 2g of vanillin, 1,200g of calcium carbonate, 300g of paraffin, 1,500g of sodium carboxymethyl cellulose, 75g of glyoxal, 75g of diethylene glycol, 150g of glycerine, 100g of fruit concentrate, 250g of raw molasses, 100g of caramel and 250 of malt extract is also stored (Box 3).

Recycled liquid with a water content of in all 1 liter obtained from a previous charge of the same type is stored (Box 5) and a quantity of water (Box 4) is stored to provide a total liquid content of the initial moist paste of 28%. The ingredients (Boxes 1 to 5) are mixed (Box 6) and the mixture is substantially homogenised by kneading (Box 7), predried by compressing (Box 8) using pressures of 700 to 800 atmospheres to give a liquid content of 17% by weight by removal of a liquid slurry. The thus predried paste is processed further as described in Example 1.

The liquid slurry obtained by squeezing is cleaned and recycled as described in Example 1.

EXAMPLE 3

The process of Example 1 was repeated with the sole difference that instead of sodium carboxymethyl cellulose, the same quantity by weight of carob bean flour was used.

EXAMPLE 4

The process of Example 1 was repeated with the sole difference that the adsorbence binders and further chemicals (Boxes 2 and 3), instead of being in the mixture from the outset (Box 6) are subsequently mixed with the already predried paste (Box 13) before this has been extruded.

What we claim is:

1. A process for the production of artificial tobacco which is free of natural tobacco, comprising the steps of intimately mixing finely divided plant parts with a liquid at a mixing station to form a homogeneous paste having a moisture content of 30–40% by weight; pressurizing and simultaneously conveying the paste past a liquid-permeable filter to reduce the moisture content to 15–25% by filtering out the surplus liquid; adding to the paste an effective amount of chemicals not later than upon completion of said conveying step; extruding the chemicals-containing pressurized paste through at least one nozzle to convert the paste into shaped artificial tobacco; and reducing the moisture content of shaped artificial tobacco to 6–18%.

2. The process of claim 1, further comprising the steps of collecting the filtered-out liquid and returning the collected liquid to said mixing station.

3. The process of claim 2, wherein said plant parts contain albumins which are filtered out with the surplus liquid, and further comprising the step of segregating albumins from collected liquid prior to returning to said mixing station.

4. The process of claim 2, wherein said plant parts contain nitrate ions which are filtered out with the surplus liquid, and further comprising the step of segregating nitrate ions from collected liquid prior to said returning step.

5. The process of claim 2, wherein said plant parts contain chloride ions which are filtered out with the surplus liquid, and further comprising the step of segregating chloride ions from collected liquid prior to said returning step.

6. The process of claim 1, wherein said step of adding chemicals includes admitting chemicals to the paste immediately prior to said extruding step.

7. The process of claim 1, wherein said pressurizing step includes subjecting the paste to gradually increasing pressure in the course of said conveying step.

8. The process of claim 1, further comprising the step of heating pressurized paste in the course of said conveying step.

9. The process of claim 8, wherein said last mentioned step includes evaporating moisture from shaped artificial tobacco as a result of said heating step.

* * * * *